US006172310B1

(12) United States Patent
Tsai et al.

(10) Patent No.: US 6,172,310 B1
(45) Date of Patent: Jan. 9, 2001

(54) SWITCHING DEVICE FOR AN ELECTRICAL CONNECTOR

(75) Inventors: Hui Tze Tsai; Nan Tsung Huang; Kun-Tsan Wu, all of Tu-Chen (TW)

(73) Assignee: Hon Ahi Precision Ind. Co. Ltd., Taipei Shien (TW)

( * ) Notice: Under 35 U.S.C. 154(b), the term of this patent shall be extended for 0 days.

(21) Appl. No.: 09/518,613

(22) Filed: Mar. 3, 2000

(51) Int. Cl.[7] ..... H01H 1/06; H01H 13/18

(52) U.S. Cl. ..... 200/51 R; 200/51.09; 200/275

(58) Field of Search ..... 200/50.28, 50.31, 200/51 R–51.06, 51.09, 51.1, 51.11, 239, 238, 243, 245–247, 275, 278, 283, 284

(56) References Cited

U.S. PATENT DOCUMENTS 4,027,131 * 5/1977 Aidn et al. ..... 200/246
4,255,634 * 3/1981 Vonder ..... 200/153 LA
4,278,855 * 7/1981 Rossi ..... 200/67 D
4,911,650 * 3/1990 Garcia Ramos ..... 439/188
5,513,999 * 5/1996 Fry et al. ..... 439/188
5,977,497 * 11/1999 Tsunematsu ..... 200/283

* cited by examiner

*Primary Examiner*—Michael Friedhofer
(74) *Attorney, Agent, or Firm*—Wei Te Chung

(57) ABSTRACT

A switching device for an electrical connector comprises a cover and a base securely assembled with the cover. A plurality of contacts comprising first contacts, second contacts, and third contacts are secured in the base. A plurality of switching terminals each includes a positioning portion, a first tab, a second tab, and a third tab. Each switching terminal forms a pushing end opposite the positioning portion, the pushing end also connecting the first tab to the third tab. The tabs respectively form first, second, and third contacting portions thereon. In operation, the first and the second contacting portions are respectively engaged with the first and second contacts when the pushing end is not being pushed laterally. When the pushing end is pushed laterally, the first contacting portion disengages from the first contact, and the third contacting portion moves to engage with the third contact, thereby switching a signal transmission.

13 Claims, 6 Drawing Sheets

SWITCHING DEVICE FOR AN ELECTRICAL CONNECTOR

BACKGROUND OF THE INVENTION

The present invention relates to a switching device, and particularly to a switching device for an electrical connector.

U.S. Pat. No. 4,393,283 discloses an electrical connector with a switching device as shown in FIG. 6. The switching device comprises a cover 60, a base 62, two slide components 64, and two rows of contacting portions 66. The slide components 64 can slidingly engage with the contacting portions 66 when it is pushed by the contacts 70, thereby switching a signal transmission therebetween. However, a disadvantage of this prior art design is that either the slide components 64 or the contacting portions 66 are apt to be broken because of the wear therebetween. Another disadvantage is that the configuration of the contact 70 is complicated, thereby increasing the costs of manufacturing and of designing the die for forming the contact.

Hence, an improved switching device for an electrical connector is required to overcome the disadvantages of the prior art.

BRIEF SUMMARY OF THE INVENTION

An object of the present invention is to provide a switching device for an electrical connector wherein the switching device has a structure capable of opening and closing without undue wear therebetween.

Another object of the present invention is to provide a switching device for an electrical connector wherein the switching terminals of the switching device has a simple structure to decrease the costs of manufacturing and of designing the die used with them.

To fulfill the above-mentioned objectives, a switching device for an electrical connector in accordance with the present invention comprises a cover and a base secured together. The base defines a plurality of receiving channels retaining a corresponding number of contacts, a stopper and a pair of securing grooves. Each contact comprises a first contact, a second contact and a third contact. A pair of switching terminals each includes a positioning portion and a first tab extending from an edge of the positioning portion. A second tab is formed on the same edge of the positioning portion of each switching terminal. A third tab extends from the distal end of the first tab and extends between the first tab and the second tab. The connecting section of the first tab and the third tab forms a pushing end adapted to be pushed laterally by the cover. Additionally, each tab forms a first contacting portion, a second contacting portion and a third contacting portion longitudinally spaced from each other for respectively contacting with a first contact, a second contact, and a third contact. Each first and second contacting portions engage with corresponding first contact and second contact when the pushing end is not being pushed laterally. When the pushing end is pushed laterally, the first contacting portion disengages from the first contact, and the third contacting portion moves to engage with the third contact, thereby switching a signal transmission therebetween.

Other objects, advantages and novel features of the invention will become more apparent from the following detailed description of the present embodiment when taken in conjunction with the accompanying drawings.

DETAILED DESCRIPTION OF THE INVENTION

Figure 1:
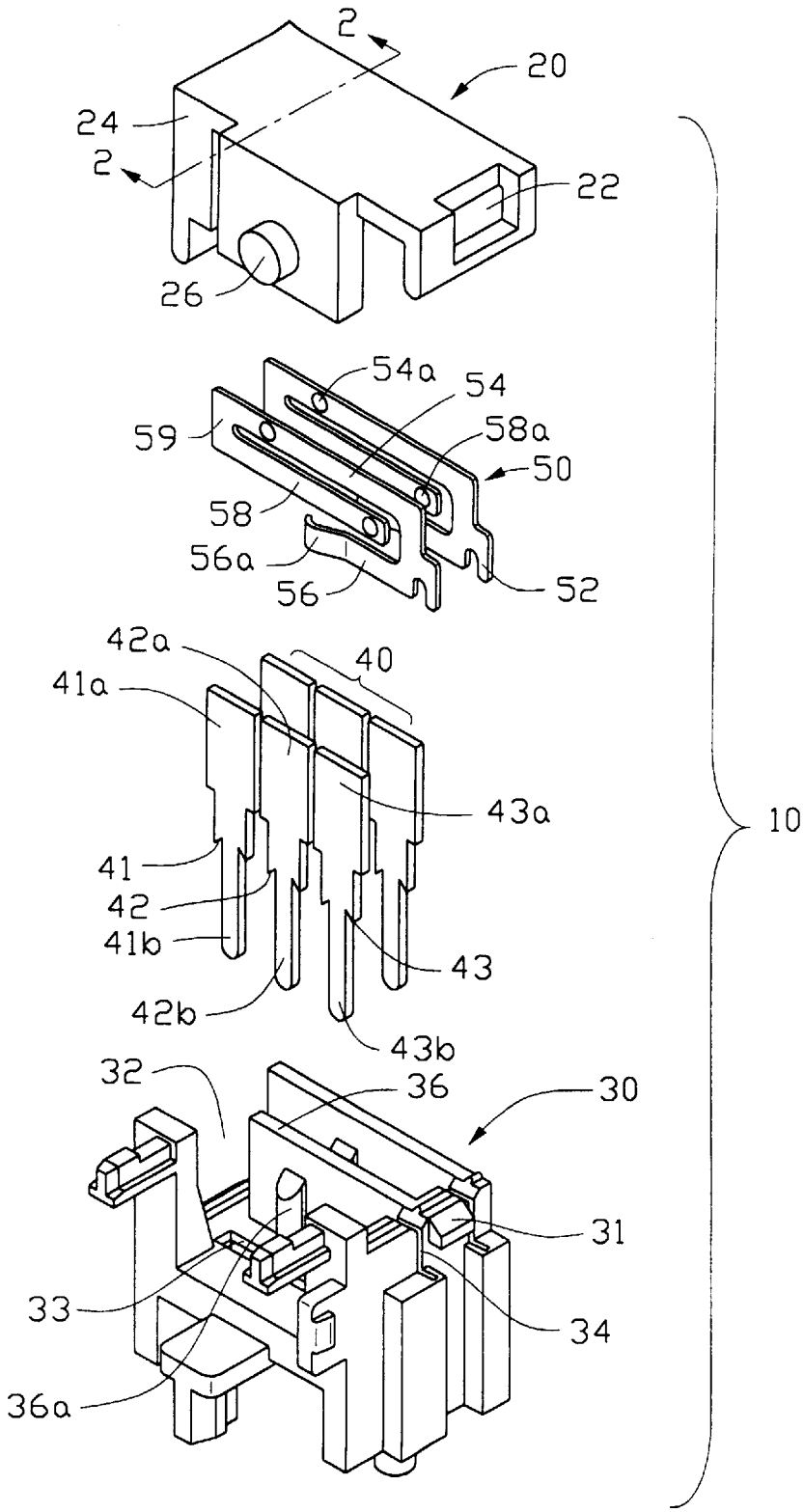
FIG. 1 is an exploded view of a switching device for an electrical connector in accordance with the present invention.

Referring to FIG. 1, a switching device 10 in accordance with the present invention comprises a cover 20, a base 30 secured with the cover 20, two rows of contacts 40 secured in the base 30, and two switching terminals 50 received in the base 30 for engaging with the contacts 40 to switch a signal transmission.

Figure 2:
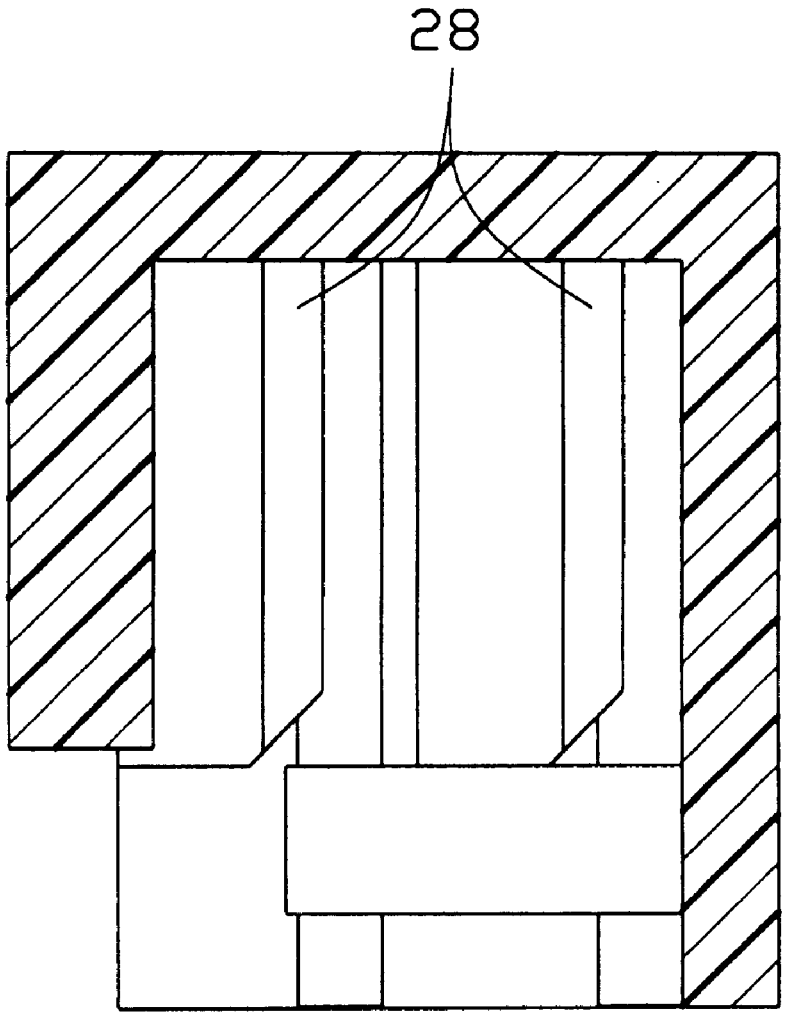
FIG. 2 is a cross-sectional view of FIG. 1 taken along line 2—2.

Also referring to FIG. 2, the cover 20 defines a slot 22 in one side, an engaging portion 24 at an opposite side, and a pushing portion 26 formed on a front side wall (not labeled) thereof. The engaging portion 24 further defines two parallel slots 28 in an inner side wall thereof. The base 30 comprises a barb 31 movably retaining within the slot 22 of the cover 20, and an engaging space 32 movably engaging with the engaging portion 24, thereby allowing the cover 20 to slide laterally on the base 30. The base 30 further includes a plurality of receiving channels 33 for receiving the contacts 40 and a pair of securing grooves 34 for retaining the switching terminals 50. The base 30 forms two plates 36 each having a stopper 36*a* thereon. Each row of the contacts 40 includes a first contact 41, a second contact 42 and a third contact 43, each respectively forming an engaging portion 41*a*, 42*a*, 43*a* and a mating portion 41*b*, 42*b*, 43*b*.

Figure 3:
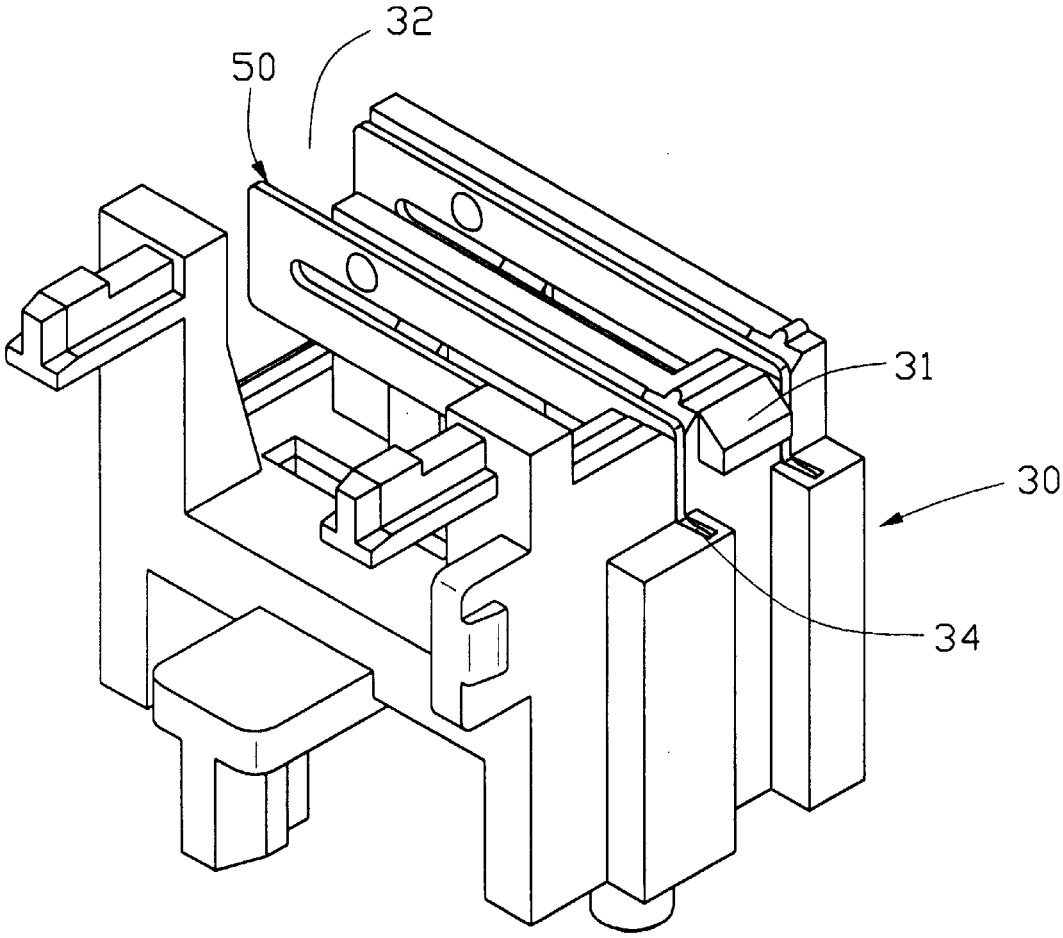
FIG. 3 is an assembled view of the switching device of FIG. 1 wherein the cover is not secured to the base.

Referring to FIGS. 1 and 3, a pair of switching terminals 50 secured within the securing grooves 34 of the base 30 each include a positioning portion 52 and a first tab 54 extending from an edge of the positioning portion 52. A second tab 56 is formed on the same edge of the positioning portion 52. A third tab 58 is formed at the distal end of the first tab 54 and extends between the first tab 54 and the second tab 56. The connecting section (not labeled) between the first tab 54 and the third tab 58 forms a pushing end 59 for securing within the corresponding slots 28 of the cover 2 and for being pushed laterally by an inserted plug (not shown) via a lateral movement of the cover 20. Additionally, the tabs 54, 56, 58 respectively form a first contacting portion 54*a*, a second contacting portion 56*a* and a third contacting portion 58*a* longitudinally spaced from each other for respectively contacting with the first contact 41, the second contact 42 and the third contact 43.

Figure 4:
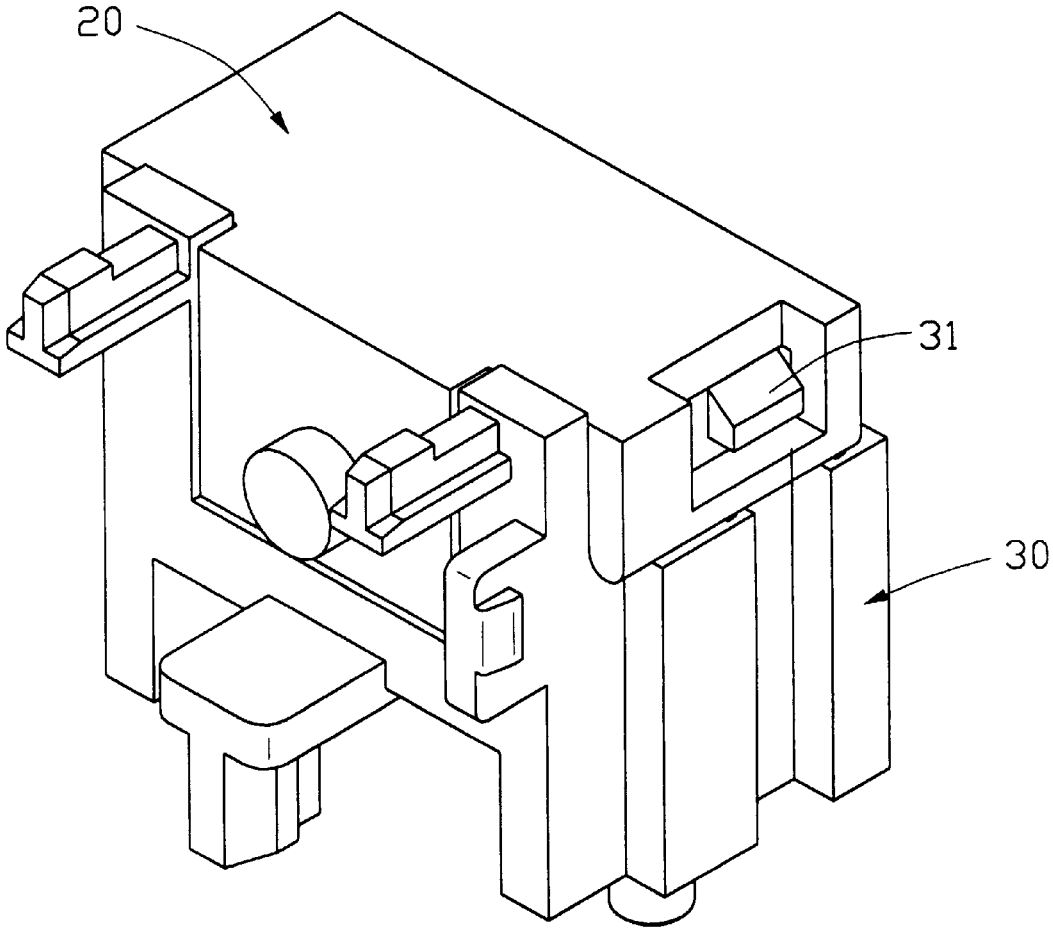
FIG. 4 is similar to FIG. 3 wherein the cover is secured onto the base.
Figure 5:
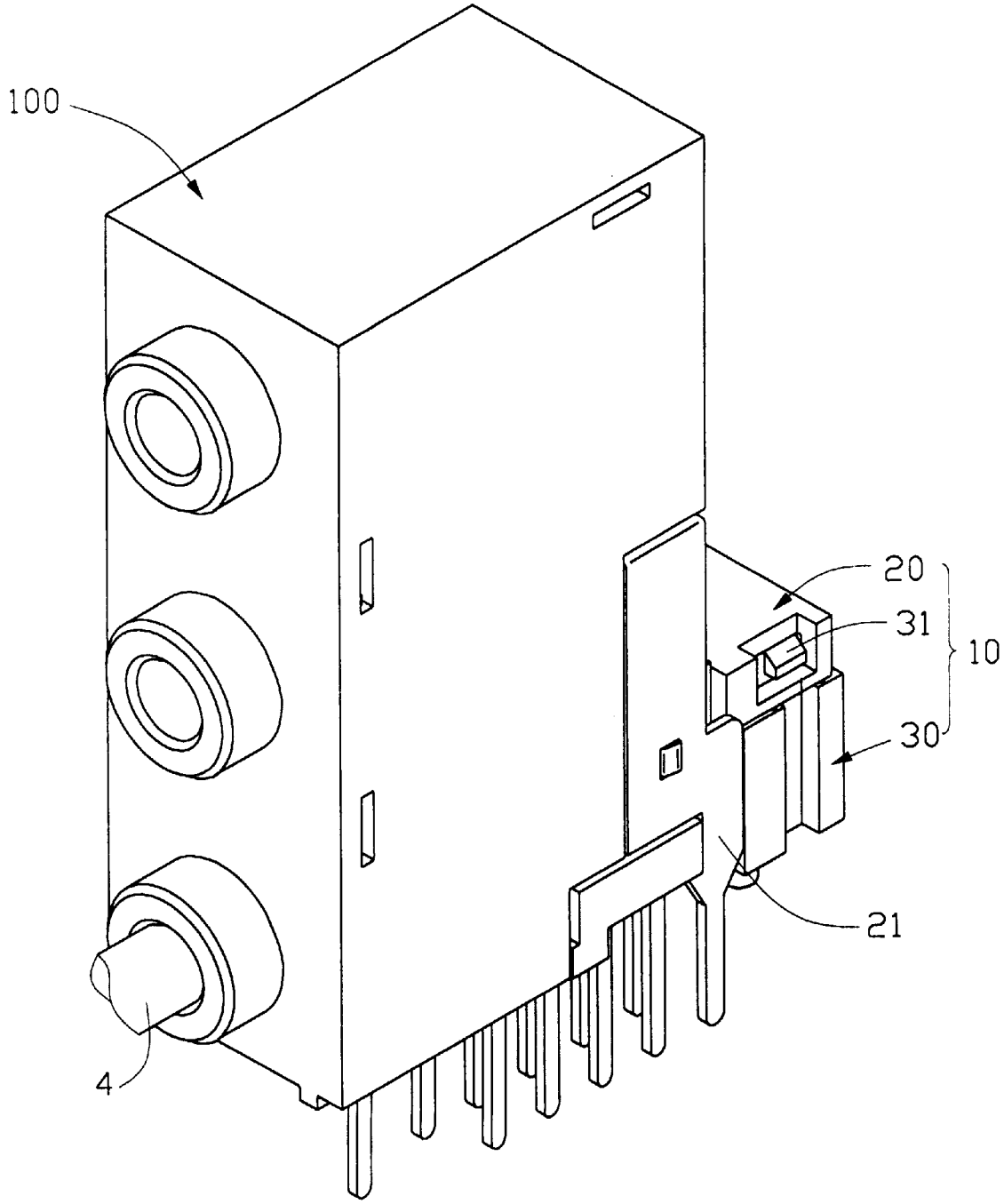
FIG. 5 is an assembled view of the switching device of the present invention and an electrical connector used with the switching device.
Figure 6:
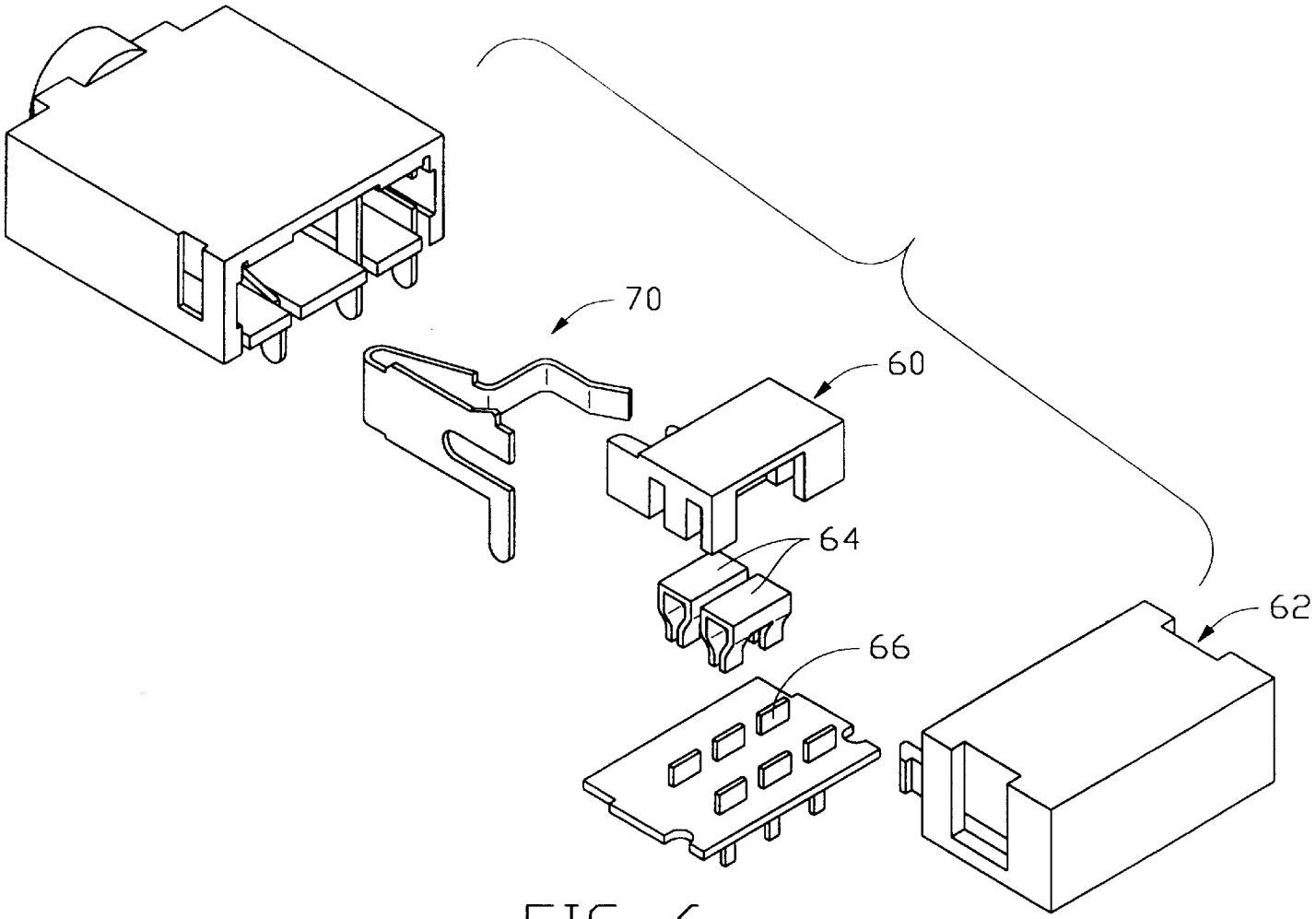
FIG. 6 (PRIOR ART)
FIG. 6 is an exploded view of a prior art switching device.

In assembly, the contacts 40 and the switching terminals 50 are secured within the receiving channels 33 and the securing grooves 34, respectively. The pushing ends 59 of the switching terminals 50 are secured in corresponding slots 28 of the cover 20 as the cover 20 is secured onto the base 30. Middle portions of the third tabs 54 are abutted by the stoppers 36*a*. Finally, the switching device 10 is mounted to an electrical connector 100 (see FIG. 4). When the plug is not inserted, the first contacting portions 54*a* and the second contacting portions 56*a* engage with the first contacts 41 and the second contacts 42. When the plug is inserted into the electrical connector 1, the cover 20 is pushed by the pushing portion 26 laterally, resulting in the pushing ends 59 secured in the corresponding slots 28 being pushed away from the contacts 41, the first contacting portions 54*a* disengaging from the first contacts 41, and the third contacting portions 58*a* moving to engage with the third contacts 43 because the middle portions of the third tabs 58 are stopped by the stoppers 36*a*, thereby switching a signal transmission. The detailed structures of the electrical connector 100 and the switching device 10 are described sufficiently in the prior art, so are not described herein.

An advantage of the present invention is that the switching device 10 has switching terminals 50 capable of engaging with the contacts 40 in a normal direction, thereby decreasing the wear therebetween. Another advantage of the present invention is that the switching terminals 50 of the switching device 10 have a simple structure, thereby decreasing the costs of manufacturing and of designing the die.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. A switching device for an electrical connector comprising:

a base defining a plurality of receiving channels and securing grooves therein;

a plurality of contacts comprising first contacts, second contacts and third contacts secured within the receiving channels of the base; and a cover secured on the base and defining a plurality of slots therein; and a number of switching terminals corresponding to the number of slots of the cover, the switching terminals being secured within the securing grooves of the base, each of the switching terminals having a positioning portion, a first tab extending from an edge of the positioning portion, a second tab extending from the edge of the positioning portion, and a third tab formed on a distal end of the first tab and extending between the first tab and the second tab, a connecting section between the first tab and the third tab forming a pushing end securable in a corresponding one of the slots of the cover and being pushed laterally by the cover as the cover is pushed laterally by an inserted plug, each of the tabs respectively forming a first contacting portion, a second contacting portion and a third contacting portion spaced apart from each other for contacting respectively with the first contact, the second contact, and the third contact; wherein each of the first contacting portions and the second contacting portions engages with corresponding ones of the first contacts and the second contacts when the pushing end is not being pushed laterally, but when the pushing end is being pushed laterally, the first contacting portions disengage from the first contacts, and the third contacting portions moves to engage with the third contacts, thereby switching a signal transmission.

2. The switching device as claimed in claim 1, wherein the first tabs, the second tabs, and the third tabs are parallel to one another, the first contacting portions are formed near the pushing end of the switching terminals, the second contacting portions each comprise an arc portion on a distal end of corresponding ones of the second tabs, and the third contacting portions are formed on a distal end of the third tabs.

3. The switching device as claimed in claim 2, wherein the base includes a plurality of vertical plates formed near the receiving channels, the vertical plates each further forming a stopper integrally protruding therefrom and corresponding to the middle portion of the third tab, thereby stopping the third tab when it is pushed laterally, and urging the third contacting portion to move in an opposite direction to engage with the third contact.

4. The switching device as claimed in claim 1, wherein the positioning portion of each of the switching terminals is an L-shaped structure, and the securing grooves of the base are each an L-shaped recess for securely engaging with the L-shaped structure.

5. A switch device for use with a jack connector and an associated plug, comprising:

a fixed base and a moveable cover commonly defining a space;

first, second and third contacts side by side positioned within the space along a lateral direction of the base;

a switch terminal extending in said lateral direction closely by said first, second and third contacts, said switch terminal including a moveable first contacting portion, a stationary second contacting portion and a moveable third contacting portion, both of said first and third contacting portions being moveable in a front-to-back direction perpendicular to said lateral direction; wherein when no plug is inserted into the connector, the first contacting portion and the second contacting portion respective engage the first contact and the second contact, and when the plug is inserted into the connector, the cover is urged to move and actuate the first contacting portion of the switch terminal to disengage the first contact, and instead actuate the third contacting portion of the switch terminal to engage the third contact.

6. The switch device as claimed in claim 5, wherein said first contacting portion and the third contacting portion are urged by the cover to move in opposite directions.

7. The switch device as claimed in claim 5, wherein said second contact is positioned between said first contact and said third contact.

8. The switch device as claimed in claim 7, wherein said second contacting portion is positioned between said first contacting portion and said third contacting portion.

9. The switch device as claimed in claim 5, wherein said cover and said first contacting portion synchronously move along the same direction.

10. A switch terminal comprising:

a positioning portion;

a first tab extending in a first direction from the positioning portion with thereon a first contacting portion adjacent a distal end thereof and away from the positioning portion;

a second tab extending in the first direction from the positioning portion with a second contacting portion thereof; and a third tab extending, in a second direction opposite to said first direction, from the distal end of the first tab with a third contacting portion thereon.

11. The switch terminal as claimed in claim 10, wherein said second contacting portion is positioned between said first contacting portion and said third contacting portion in a horizontal direction.

12. The switch terminal as claimed in claim 10, wherein said third tab is positioned between said first tab and said second tab in a vertical direction.

13. The switch terminal as claimed in claim 12, wherein all the first, second and third tabs extend in a parallel relation with one another.

* * * * *